US005673882A

United States Patent [19]

Huang

[11] Patent Number: 5,673,882

[45] Date of Patent: Oct. 7, 1997

[54] COMBINATION-TYPE DESK LEG

[76] Inventor: Huei-Mien Huang, No. 23, Su Fun, Su Fun Village, Chi Ku Hsiang, Tainan Hsien, Taiwan

[21] Appl. No.: 597,992

[22] Filed: Feb. 7, 1996

[51] Int. Cl.[6] ..... A47B 91/00

[52] U.S. Cl. ..... 248/188.8; 108/153

[58] Field of Search ..... 248/188.8, 188.9, 248/188.91, 188; 108/153, 156

[56] References Cited

U.S. PATENT DOCUMENTS

| | | | |
|---|---|---|---|
| 5,050,829 | 9/1991 | Sykes | 248/188.8 |
| 5,163,373 | 11/1992 | Anderson et al. | 248/188 X |
| 5,427,341 | 6/1995 | Gutgsell | 248/188 |

*Primary Examiner*—Ramon O. Ramirez
*Attorney, Agent, or Firm*—Browdy and Neimark

[57] ABSTRACT

A combination desk leg is composed of a leg base, a top base, two support tubes, a connection member, and two cover plates. The leg base is provided in the top thereof with two locating holes. The top base is provided in the underside thereof with two locating holes. Two support tubes are provided respectively with two insertion ends having a pivoting hole. The bottom insertion ends of two support tubes are received respectively in the locating holes of the leg base and the top base such that the bottom insertion ends are fastened securely with the locating holes by the fastening elements. The connection member is mounted on the top of the top base for connecting the desk leg with the desk top. The cover plates are provided respectively with a plurality of retaining elements for fastening the cover plates with the top base, the leg and the support tubes.

5 Claims, 4 Drawing Sheets

COMBINATION-TYPE DESK LEG

FIELD OF THE INVENTION

The present invention relates generally to a desk leg, and more particularly to a combination desk leg having a plurality of units that can be arranged or fitted together.

BACKGROUND OF THE INVENTION

The conventional desk legs are generally made of a plurality of rods or steel tubes, which are fastened together to support a desk top. Such conventional desk leg are defective in design in that the rods or steel tubes can not be connected easily and firmly, and that they are not formed of units of different materials.

SUMMARY OF THE INVENTION

It is therefore the primary objective of the present invention to provide a combination desk leg, which can be formed easily and firmly.

It is another objective of the present invention to provide a combination desk leg formed of units of different materials.

The objectives, features and functions of the present invention will be readily understood upon a thoughtful deliberation of the following detailed description of the present invention in conjunction with the accompanying drawings.

DETAILED DESCRIPTION OF THE INVENTION

Figure 1:
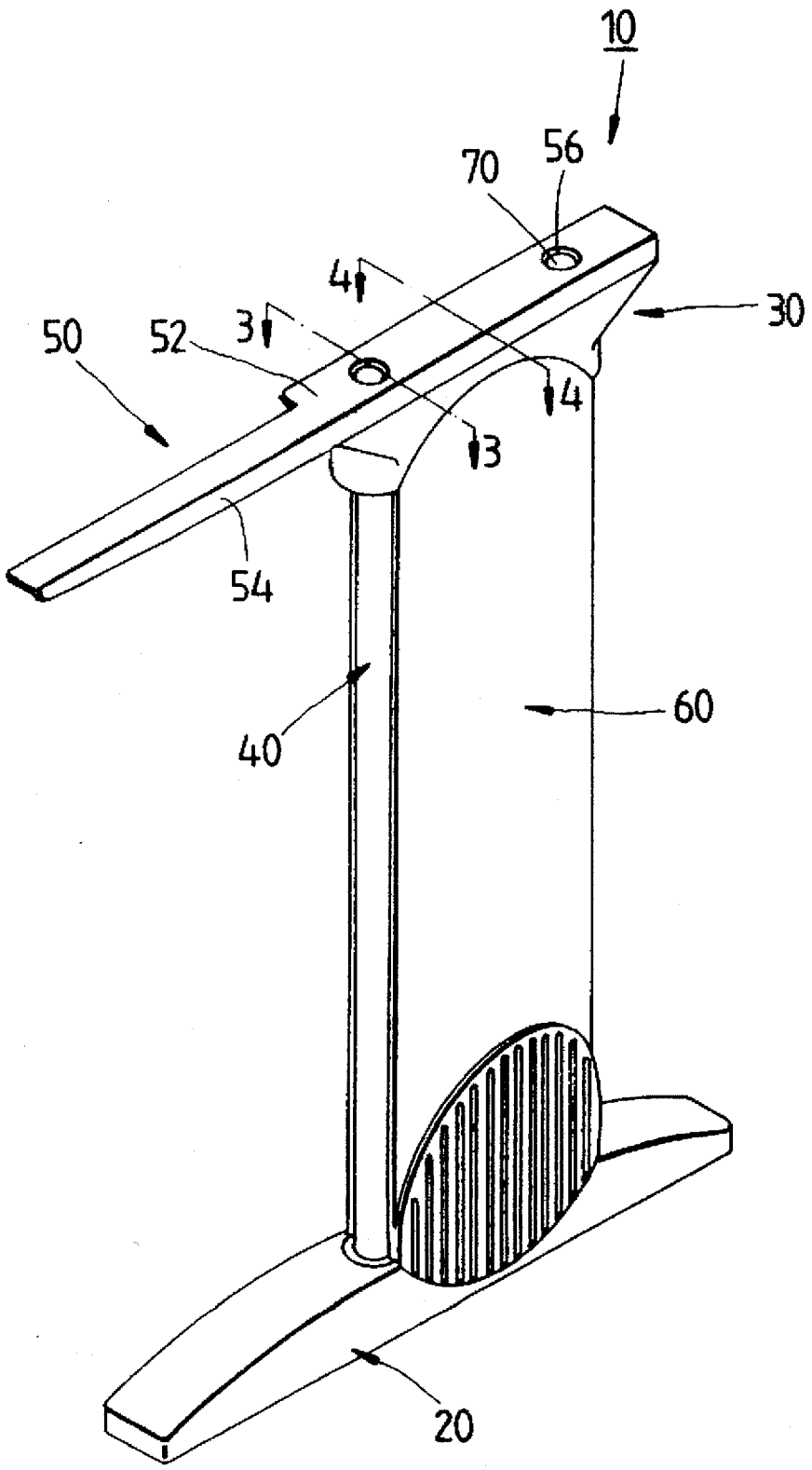
FIG. 1 shows a perspective view of a first preferred embodiment of the present invention.

As shown in FIG. 1, a combination desk leg 10 of the first preferred embodiment of the present invention comprises the component parts, which are described explicitly hereinafter.

Figure 2:
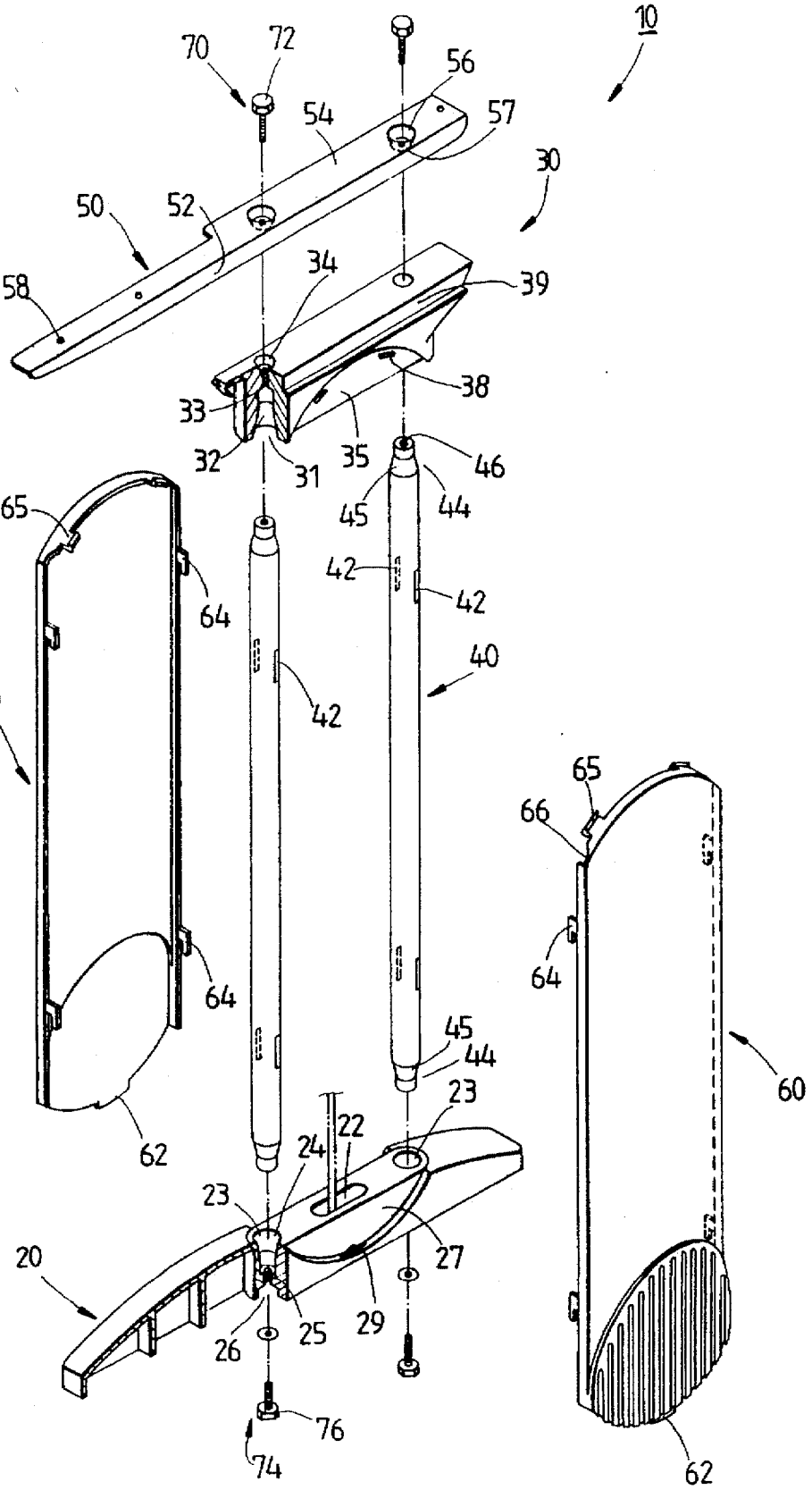
FIG. 2 shows a partial exploded view of the first preferred embodiment of the present invention.

A leg base 20 of a plastic material is provided at the center of the top thereof with a long hole 22 for accommodating an electric wire indicated by an imaginary line as shown in FIG. 2. The long hole 22 is provided respectively in the front and the rear sides thereof with a locating hole 23 which is in turn provided in the hole edge thereof with a holding portion 24 of a tapered construction. Each of the locating holes 23 is provided at the bottom end thereof with a through hole 25 reaching the underside of the leg base 20. The underside of the leg base 20 is provided with two receiving holes 26 having a diameter greater than that of the through hole 25. Each receiving hole 26 is coaxial with the locating hole 23 and is in communication with the through hole 25. The leg base 20 is provided correspondingly and respectively in one side thereof with a receiving portion 27 having an arcuate bottom 28 which is provided with a slot 29.

A top base 30 of a plastic material is provided with a flat surface and is provided in the underside thereof with two locating holes 31 spaced at a predetermined interval. The locating holes 31 is provided respectively in the hole edge thereof with a holding portion 32 of a tapered construction. Each locating hole 31 is provided at the top end thereof with a through hole 33 reaching the upper side of the top base 30. The upper side of the top base 30 is provided with two receiving holes 34 greater in diameter than the through hole 33. Each receiving hole 34 is coaxial with the locating hole 31 and is in communication with the through hole 33. The top base 30 is provided correspondingly and respectively in one side thereof with a receiving portion 35 which is provided with two insertion holes 38. The top base is further provided respectively in one side thereof with a resting portion 39 which is located over the receiving portion 35.

Figure 3:
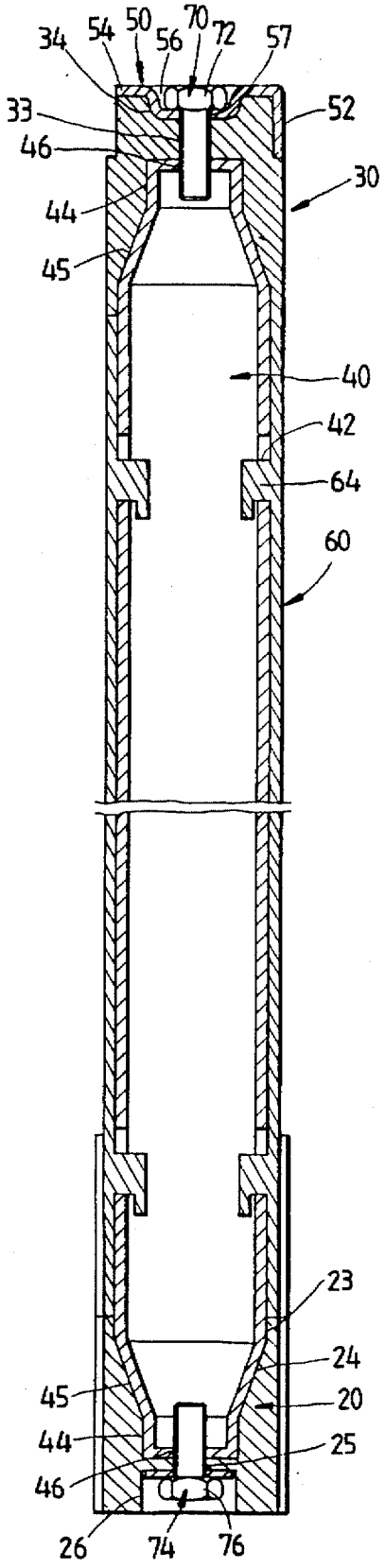
FIG. 3 shows a sectional view of a portion taken along the line 3—3 as shown in FIG. 1.

Two support tubes 40 of a metal material are provided respectively in the periphery thereof with a slot 42 and are further provided respectively with two insertion ends 44. Each insertion end 44 is provided in the periphery thereof with a holding portion 45 of a tapered construction and is further provided in the end surface thereof with a pivoting hole 46. The insertion ends 44 of the bottom ends of the support tubes 40 are received in the locating holes 23 of the leg base 20, as shown in FIG. 3, such that the holding portions 45 of the insertion ends 44 are in an intimate contact with the holding portions 32 of the locating holes 31.

One connection member 50 of a metal material has an L-shaped cross section, an upright wall 52, and a horizontal wall 54 which is provided by punching with two recessed portions 56 spaced at an interval. Each recessed portion 56 is provided at the center thereof with a through hole 57. The horizontal wall 54 is provided with a plurality of connection holes 58 and is in contact with the upper side of the top base 30, as shown in FIG. 3. The upright wall 52 is in contact with the resting portion 39 of the top base 30. The bottoms of the recessed portions 56 are located in the receiving holes 34 of the top base 30. Two fastening elements 70 are received in the through holes 57 of the connection member 50 and the through holes 33 of the top base 30 such that two fastening elements 70 are fastened pivotally in the pivoting holes 46 of the insertion ends of the top ends of the support tubes 40, and that the heads 72 of the fastening elements 70 are received in the recessed portions 56 of the connection member 50. Another two fastening elements 74 are received in the receiving holes 26 and the through holes 25 of the leg base 20 such that the fastening elements 74 are fastened pivotally in the pivoting holes 46 of the insertion ends 44 of the bottom ends of the support tubes 40, and that the heads 76 of the fastening elements 74 are located in the receiving holes 26 of the leg base 20.

Figure 4:
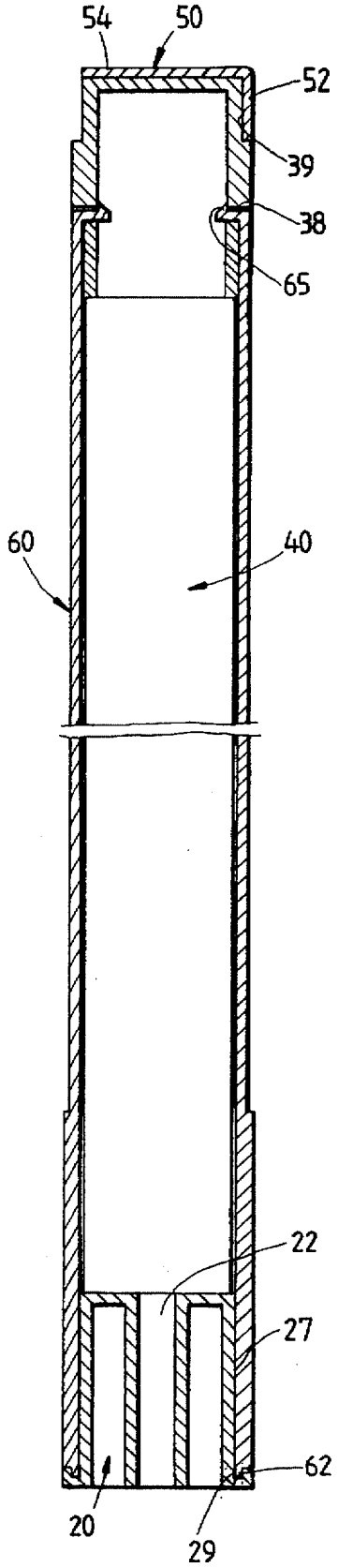
FIG. 4 shows a sectional view of a portion taken along the line 4—4 as shown in FIG. 1.

Two cover plates 60 are provided respectively with an arcuate top and an arcuate bottom which is in turn provided with an insertion portion 62. Each cover plate 60 is provided in two sides thereof with a plurality of hooked portions 64 corresponding in location to the slots 42 of the support tubes 40. Each cover plate 60 is provided in the top edge thereof with two retaining portions 65 corresponding in location to the insertion holes 38 of the top base 30, and with a cut 66 dimensioned to allow an electric wire to be put therethrough. The insertion portion 62 of the bottom end of the cover plate 60 is received in the slot 29 of the leg base 20 while the hooked portions 64 are engaged with the slots 42 of the support tubes 40. Two retaining portions 65 of the top end of the cover plate 60 are retained in the insertion holes 38 of the top base 30, as shown in FIG. 4. The top and the bottom ends of the cover plate 60 are received respectively in the receiving portion 27 of the leg base 20 and the receiving portion 35 of the top base 30.

In combination, the bottom ends of two support tubes 40 are connected with the leg base 20 while the top ends of the support tubes 40 are connected with the top base 20. The connection member 50 is located on the top base 30. The connection member 50, the top base 30 and the insertion end 44 of the top end of the support tube 40 are fastened securely by means of two fastening elements 70. In the meantime, the leg base 20 and the insertion end 44 of the bottom end of the support tube 40 are fastened securely by means of two fastening elements 74. The cover plates 60 are joined with two sides of the main body of the desk leg.

When the top end of the support tube 40, the top base 30 and the connection member 50 are fastened together by the fastening elements 70, the insertion end 44 is forced by the fastening elements 70 to enter the locating hole 31 such that the holding portion 45 of the insertion end 44 is in an intimate contact with the holding portion 32 of the locating hole 31. As a result, the support tube 40 is engaged securely with the locating hole 31. Similarly, the holding portion 24 of the leg base 20 is fastened intimately with the holding portion 45 of the insertion end 44 of the support tube 40, thanks to the fastening effect of the fastening elements 74. Therefore, the leg base 20, the top base 30 and two support tubes 40 are held together securely to form a tetragonal structure. In addition, the insertion portions 62, the hooked portions 64 and the retaining portions 65 of the cover plates 60 are engaged respectively with the top base 30, the support tubes 40 and the leg base 20. The top and the bottom ends of the cover plates 60 are received respectively in the receiving portions 35 of the top base 30 and the receiving portions 27 of the bottom base 20. The cover plates 60 can be detached from the desk leg 10 to facilitate the wiring of the desk leg 10.

Figure 5:
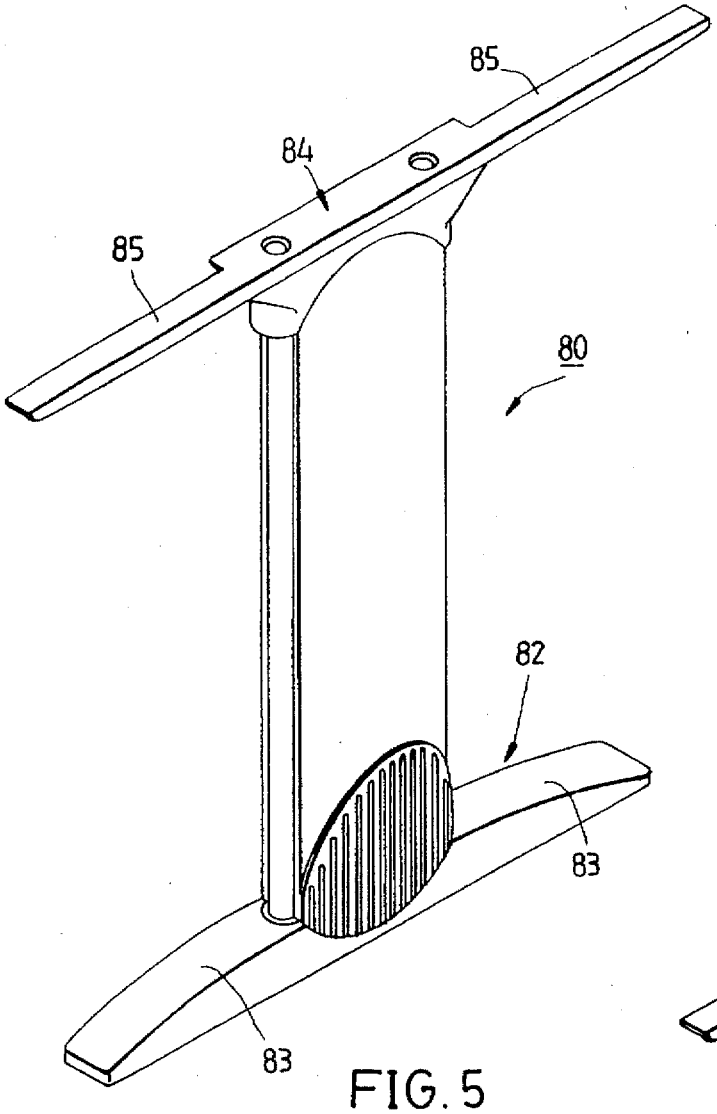
FIG. 5 shows a schematic view of a second preferred embodiment of the present invention.
Figure 6:
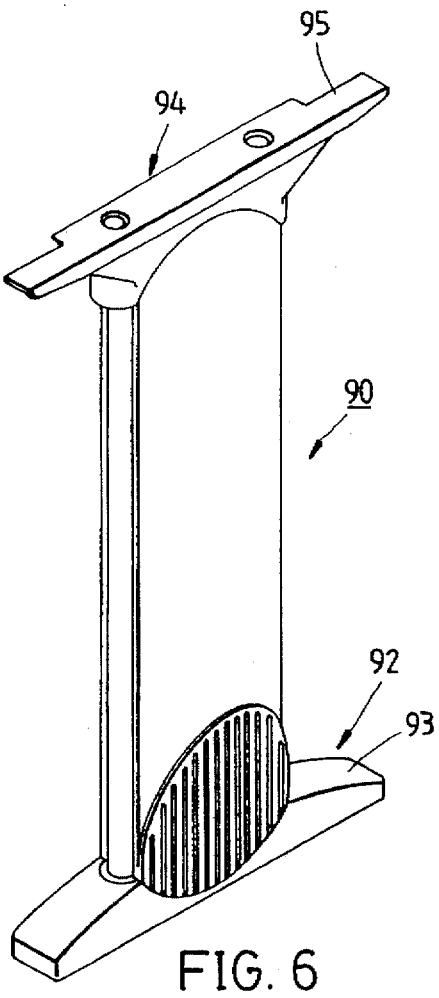
FIG. 6 shows a schematic view of a third preferred embodiment of the present invention.

As shown in FIG. 1, the leg base 20 has a long end and a short end. Similarly, the connection member 50 has a long end and a short end. The sizes of the leg base 20 and the connection member 50 can be varied to fit the desk tops of various sizes, as shown in FIG. 5. The leg base 82 of the desk body 80 has two long ends 83 while the connection member 84 has two long ends 85 so as to fit a large desk top. On the other hand, as shown in FIG. 6, the leg base 92 of the desk body 90 has two short ends 93 while the connection member 94 has two short ends 95 so as to fit a small desk top.

The desk legs of the present invention are fastened securely with the desk top such that the desk legs do not sway and that the desk legs can be fastened with the desk top easily and rapidly. In addition, the desk leg of the present invention is formed of the component parts of different materials, such as the support tubes of a metal material, and the leg base, the top base and the cover plates of a plastic material.

The embodiments of the present invention described above are to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A combination-type desk leg, which comprises:

a leg base provided axially on a top thereof with two locating holes spaced at an interval, said two locating holes provided respectively in a hole edge thereof with a holding portion of a tapered construction, said two locating holes further provided respectively in a bottom end thereof with a through hole having an inner diameter smaller than an inner diameter of said locating holes, said through hole having one end reaching an underside of said leg base, said leg base further provided respectively in two sides thereof with at least one slot;

a top base provided in an underside thereof with two locating holes spaced at an interval and extending along a longitudinal axis of said top base, said two locating holes provided respectively in a hole edge thereof with a holding portion of a tapered construction and further provided respectively in a top end thereof with a through hole having an inner diameter smaller than an inner diameter of said locating holes, said through hole having one end reaching a top of said top base, said top base further provided respectively in two sides thereof with a predetermined number of insertion holes;

two support tubes provided respectively in a periphery thereof with a predetermined number of slots and further provided respectively at both ends thereof with two insertion ends, each of said two insertion ends provided in a periphery thereof with a holding portion of a tapered construction, each of said two insertion ends provided in an end thereof with a pivoting hole, said insertion end of a bottom end of each of said two support tubes being received in one of said locating holes of said leg base such that said holding portion of said insertion end of said bottom end is engaged with said holding portion of said locating hole, said insertion end of a top end of each of said two support tubes being received in one of said locating holes of said top base such that said holding portion of said insertion end of said top end is engaged with said holding portion of said locating hole, said two support tubes being parallel to each other;

a connection member having a horizontal wall provided with two through holes separated at an interval, said horizontal wall being in contact with a top of said top base such that said through holes of said horizontal wall are corresponding in location to said through holes of said top base, and that two fastening elements are received in said through holes of said horizontal wall and said top base, and further that said two fastening elements are pivoted in said pivoting holes of said insertion ends of said top ends of said two support tubes, said two through holes of said leg base receiving therein two fastening elements which are pivoted in said pivoting holes of said insertion ends of said bottom ends of said two support tubes; and two cover plates provided respectively at a bottom thereof with at least one insertion portion, said two cover plates further provided respectively in two lateral peripheries thereof with a predetermined number of hooked portions and still further provided respectively in a bottom edge thereof with a predetermined number of retaining portions, said insertion portion of said cover plates being received in said slot of said top base, said hooked portions being engaged with said slots of said two support tubes, said retaining portions being engaged with said insertion holes of said top base.

2. The combination-type desk leg as defined in claim 1, wherein said leg base comprises two receiving holes located in an underside of said leg base, said receiving holes having a diameter greater than a diameter of said through holes, said receiving holes being coaxial with said locating holes and communicating with said through holes; wherein said top base comprises two receiving holes greater in diameter than said through holes and located in said top of said top base such that said receiving holes are coaxial with said locating holes and that said receiving holes are in communication with said through holes; wherein said horizontal wall of said connection member is provided by punching with two recessed portions separated at an interval, each of said two recessed portions having at a center thereof a through hole, said two recessed portions of said connection member being received in said two receiving holes of said top base; and wherein said receiving holes of said leg base and said recessed portions of said connection member are intended to accommodate heads of said fastening elements.

3. The combination-type desk leg as defined in claim 1, wherein said leg base is provided respectively in two sides thereof wand a receiving portion having a cut facing upwards and a bottom edge provided with said slot; wherein said top base is provided respectively in two sides thereof with a receiving portion having a cut facing downwards, said insertion holes being located in an end surface of said receiving portions; and wherein bottoms of said cover plates are in contact with said receiving portions of said leg base and said top base.

4. The combination-type desk leg as defined in claim 1, wherein said top base is provided in a top edge of one side thereof with a resting portion; and wherein said horizontal wall of said connection member is provided in one side thereof with an upright wall extending downwards and making contact with said resting portion of said top base when said connection member is mounted on said top base.

5. The combination-type desk leg as defined in claim 1, wherein said leg base is provided in a top thereof with a long through hole located between said two locating holes; and wherein each of said cover plates is provided in a top edge thereof with a recessed portion for receiving an electric wire.

* * * * *